US009719275B1

(12) United States Patent
Tobias et al.

(10) Patent No.: US 9,719,275 B1
(45) Date of Patent: Aug. 1, 2017

(54) LOCK PIN ROTATIONAL POSITION SETTING KEY AND METHOD OF USE

(76) Inventors: Marc W. Tobias, Sioux Falls, SD (US); Tobias Bluzmanis, Doral, FL (US)

( * ) Notice: Subject to any disclaimer, the term of this patent is extended or adjusted under 35 U.S.C. 154(b) by 0 days.

(21) Appl. No.: 12/074,657

(22) Filed: Mar. 5, 2008

Related U.S. Application Data

(60) Provisional application No. 60/906,379, filed on Mar. 12, 2007, provisional application No. 60/920,305, filed on Mar. 27, 2007.

(51) Int. Cl.

| | |
|---|---|
| ***E05B 19/06*** | (2006.01) |
| ***E05B 19/20*** | (2006.01) |
| ***E05B 19/00*** | (2006.01) |
| *E05B 27/00* | (2006.01) |

(52) U.S. Cl.
CPC ..... *E05B 19/20* (2013.01); *E05B 19/0023* (2013.01); *E05B 19/0035* (2013.01); *E05B 27/0039* (2013.01); *Y10T 70/761* (2015.04); *Y10T 70/7797* (2015.04)

(58) Field of Classification Search
CPC .... E05B 19/20; E05B 19/205; E05B 27/0082; E05B 27/0078; E05B 19/0023; E05B 19/0029; E05B 27/0042; E05B 27/0039; E05B 27/0053; E05B 19/035; E05B 19/0017; E05B 19/0052; Y10T 70/761; Y10T 70/7616; Y10T 70/7797; Y10T 70/7881
USPC ..... 70/394, 409, 494, 495, 493, 419, 421, 70/496, 376, 378, 392
See application file for complete search history.

(56) References Cited

U.S. PATENT DOCUMENTS

| | | | |
|---|---|---|---|
| 1,667,223 | A | 4/1928 | Simpson |
| 3,080,744 | A | 3/1963 | Spain |
| 3,499,302 | A | 3/1970 | Spain |
| 3,499,303 | A | 3/1970 | Spain |
| 3,722,240 | A | 3/1973 | Spain et al. |

(Continued)

FOREIGN PATENT DOCUMENTS

| | | |
|---|---|---|
| GB | 251810 | 5/1926 |
| JP | 52-51298 | 4/1977 |

OTHER PUBLICATIONS

Marc Weber Tobias, "Opening Locks by Bumping in Five Seconds or Less . . . ", Apr. 4, 2006, pp. 1-28, www.security.org.

(Continued)

*Primary Examiner* — Lloyd Gall
(74) *Attorney, Agent, or Firm* — Jeffrey A. Proehl; Woods, Fuller, Shultz & Smith, P.C.

(57) ABSTRACT

A pin setting key for setting rotational orientations of pins of a lock. The key includes a bow portion and a blade portion for inserting into a keyway. The blade portion has a longitudinal axis and a bow end and a tip end, with a plurality of bitting positions located between the bow and tip ends. Each of the bitting positions corresponds to one of the pins of the plug such that insertion of the blade portion into the keyway aligns the bitting position with one of the pins. Each bitting position includes at least one bitting surface configured to rotate a pin when the contact surface of the pin contacts the bitting surface. Each bitting surface is offset from a central location of the respective bitting position. Each bitting surface has an axis extending generally transverse to the longitudinal axis of the blade.

1 Claim, 5 Drawing Sheets

(56) References Cited

U.S. PATENT DOCUMENTS

| | | | | | |
|---|---|---|---|---|---|
| 3,837,197 | A | * | 9/1974 | Lopez | 70/494 |
| 3,985,010 | A | | 10/1976 | Idoni | |
| 3,987,654 | A | | 10/1976 | Iaccino et al. | |
| 3,999,413 | A | | 12/1976 | Raymond | |
| RE30,198 | E | * | 1/1980 | Oliver et al. | 70/494 |
| 4,208,894 | A | * | 6/1980 | Surko, Jr. | 70/494 |
| 4,377,940 | A | | 3/1983 | Hucknall | |
| 4,450,699 | A | * | 5/1984 | Genakis | 70/494 |
| 4,478,061 | A | | 10/1984 | Preddey | |
| 4,535,546 | A | | 8/1985 | Smith | |
| 4,635,455 | A | | 1/1987 | Oliver | |
| 4,638,651 | A | | 1/1987 | Surko | |
| 4,667,494 | A | | 5/1987 | Joosten | |
| 4,712,399 | A | | 12/1987 | Mattossovich | |
| 4,723,427 | A | | 2/1988 | Oliver | |
| 4,732,022 | A | | 3/1988 | Oliver | |
| 4,966,021 | A | | 10/1990 | Boag | |
| 5,167,171 | A | | 12/1992 | Heredia | |
| 5,172,578 | A | | 12/1992 | Bitzios | |
| 5,224,365 | A | | 7/1993 | Dobbs | |
| 5,570,601 | A | | 11/1996 | Field | |
| 5,956,984 | A | | 9/1999 | Hughes | |
| 5,956,986 | A | | 9/1999 | Vonlanthen | |
| 5,966,973 | A | * | 10/1999 | Watts | 70/494 |
| 5,987,946 | A | | 11/1999 | Watts | |
| 6,041,629 | A | | 3/2000 | Hughes | |
| 6,138,486 | A | | 10/2000 | Hughes | |
| 6,173,595 | B1 | | 1/2001 | Hughes | |
| 6,382,007 | B1 | | 5/2002 | Wright | |
| 6,477,875 | B2 | | 11/2002 | Field et al. | |
| 6,481,255 | B2 | | 11/2002 | Theriault | |
| 6,490,898 | B1 | | 12/2002 | Mottura | |
| 6,722,172 | B2 | | 4/2004 | Pinkhasov et al. | |
| 6,945,082 | B2 | | 9/2005 | Field et al. | |
| 7,665,336 | B2 | * | 2/2010 | Widen | 70/409 |
| 2004/0069030 | A1 | | 4/2004 | Takadama | |
| 2005/0172688 | A1 | * | 8/2005 | Widen | 70/495 |
| 2007/0028658 | A1 | * | 2/2007 | Widen | 70/493 |
| 2008/0202180 | A1 | * | 8/2008 | Eller et al. | 70/493 |

OTHER PUBLICATIONS

Marc Weber Tobias, "Bumping of Locks: Legal Issues in the United States", 2006, pp. 1-11, www.security.org.

Marc Weber Tobias, "The Lockdown: Locked, but not secure (Part 1)", Aug. 24, 2006, pp. 1-5, www.engadget.com.

* cited by examiner

LOCK PIN ROTATIONAL POSITION SETTING KEY AND METHOD OF USE

REFERENCE TO RELATED APPLICATIONS

This application claims the benefit of U.S. Provisional Application No. 60/906,379, filed Mar. 12, 2007, the disclosure of which is incorporated herein in its entirety, and U.S. Provisional Application No. 60/920,305 filed Mar. 27, 2007, the disclosure of which is incorporated herein in its entirety.

BACKGROUND

Field

The present disclosure relates to devices and methods of compromising locks, and more particularly pertains to a new lock pin rotational position setting key and method of use for compromising high security locks.

Description of the Prior Art

Locks employing pin tumblers have long been utilized for providing security for buildings such as homes and businesses. Pin tumbler locks include a plug that is inserted into a shell, and the plug may be rotated with respect to the shell when the correct key for the lock is used on the lock. The plug includes a keyway for removably receiving the blade of the key. The blade of the key engages a plurality of pin tumblers arranged along the keyway to contact the blade of the key at different and discrete locations. The pin tumblers each comprise a lower or bottom pin (sometimes referred to a key pin) that contacts the key blade, and an upper or top pin (sometimes referred to as a driver pin) that is pushed or lifted upwardly by the bottom pin. The top and bottom pins are positioned in a bore that extends from the keyway in the plug through and into the shell, and in the locked or vertical position of the plug the bores in the plug are substantially aligned with the bores in the shell.

The blade of the key is bitted, or cut, at a plurality of positions along the blade and in a unique pattern that is adapted to the configuration of the pin tumblers of that lock. The height of the bottom and top pins of each pin tumbler varies from tumbler to tumbler, so that the bitting for one position may not work for another position. The bitting at each position is such that the bottom pin is raised in the bore until the juncture between the bottom pin and the top pin lies in a shear line, which is located at the point where the bore in the plug and the bore in the shell meet. When the proper key is inserted, the junctures between the top and bottom pins are aligned with the shear line between the plug and shell, and the plug will freely rotate with respect to the shell. In other words, a key with the proper biting places the top pins in the completely in the shell and the bottom pins completely in the plug, and the plug is able to rotate in this condition. The rotation of the plug may actuate a mechanism that moves, for example, a deadbolt or door latch.

High security locks are utilized to present an extremely pick resistant cylinder for commercial, government, and military applications where a high level of security against covert entry is required. Certain types of high security locks are known to utilize pin tumblers in which the bottom pins are both lifted and rotated by the interaction of the bitting of the key with the pin tumblers. In such instance a vertical aspect of the bitting of the key blade elevates the upper surface of the bottom pins to the shear line while an angular portion of the bitting rotates the pin to a particular angle.

One known high security lock structure is available from Medeco of Salem, Va., and aspects of various Medeco locks are disclosed, for example, in U.S. Pat. No. 3,499,303 and U.S. Pat. No. 3,722,240 (the disclosure of each of these patents being incorporated herein by reference in their respective entireties). In these locks, one (or more) of three available angles is employed for the angular bitting to cause the pin to rotate with respect to the bore. For example, in some of these types of locks, the pin may be rotated by the angular bitting of key to a position substantially parallel to a central axis extending substantially transverse of the blade, a position rotated twenty degrees left of the central axis or a position rotated twenty degrees right of the central axis. The rotation of the pins into their proper rotational position permits gates on the pins to be aligned so that legs on a sidebar are able to move into the gates and the sidebar can in turn be moved from a position that extends out of the plug and into the shell to a position that is retracted into the plug, thus allowing the plug to rotate with respect to the shell. Some variations of this lock, referred to as a "biaxial" design as is disclosed for example in U.S. Pat. No. 4,635,455, positional bitting is employed in which the contact surface of each pin may be located in one of two positions within the respective plug bore—either before or after the center line of the plug bore. The combination of the three rotational bittings, two positional bittings and several vertical bittings are believed to offer maximum resistance against all forms of covert entry by providing more than 46,000 sidebar codes in addition to approximately 3,000,000 theoretical combinations of vertical bitting, angular bitting, and positional bitting.

The introduction of the sidebar to high security locks provided an extremely high resistance to almost all forms of picking and decoding by locks so equipped. As a result, lock designs that employ the combination of the pin tumblers and a sidebar, such as the Medeco lock, have been considered to be the most difficult cylinders to compromise by covert means, and have been certified as meeting the criteria for UL 437 and ANSI 156.30 for high security locks. In part this certification is due to the unique sidebar design that provides a high resistance to most methods of picking and decoding. Although several tools are known to have been developed to attempt to bypass locks including the sidebar, these tools have all required a high skill level to utilize and often were not considered to be effective.

In 2004, the technique of "bumping" attracted worldwide attention as a "new" method of bypass for almost all of the conventional pin tumbler lock designs. This practice was apparently patented in the United Kingdom in 1925 (United Kingdom Patent No. 251,810), and had been known by locksmiths for many years. Bumping involves the use of a specially cut key that is rapidly and forcefully moved in the keyway of the lock to cause the pin tumblers to jump in the bores, and the bottom and top pins to momentarily separate, so that rotational torque applied to the plug may cause the plug to rotate when the separation be between the top and bottom pins align with the shear line. This technique has placed almost all pin tumbler cylinders at risk. However, locks that employed sidebar technology were heretofore believed to be immune to being compromised by bumping. In fact, manufacturers of locks employing sidebar technology have touted this perceived immunity to the bumping technique in sales information, stating that the locks are "bump proof." However, the present disclosure provides a method to open a significant percentage of sidebar locks by bumping and picking.

The high security locks upon which the techniques and devices of the present disclosure are effective typically implement two separate yet integrated locking systems. The first system is the conventional pin tumbler system in which a properly bitted key positions the split or juncture between the top and bottom pins with the shear line between the plug and shell.

The second system is the sidebar system in which a properly bitted key rotates the bottom pins to align side channels or gates in the pins such that the gates permit the side bar to move inwardly with respect to the plug and out of engagement with the shell. Correct alignment by rotation of each bottom pin tumbler to one of three angle positions of the key causes a gate within each pin to be aligned with the corresponding protruding leg of the sidebar. Only when the gates in all of the pins are horizontally and vertically aligned can the sidebar be retracted into the plug to allow turning by the key.

Thus, only the combination of the alignment of the split or juncture of the pins with the shear line and the ability of the side bar to move inwardly allows rotation of the plug with respect to the shell. Both of these systems must be properly aligned at the same time before the plug is allowed to rotate within the shell.

Some high security locks incorporate a third system for key control and security. The third system is a slider, which is a movable component controlled by a protrusion on the side of the correctly configured key which causes the slider to move laterally toward the rear of the keyway as the key is inserted into the keyway in order to allow (or block) the inward movement of the primary sidebar. The technology employed in such as system is disclosed, for example, in U.S. Pat. No. 6,945,082, which is incorporated herein by reference in its entirety. There are a number of different positions to which the slider can be moved by a step on a change key, a master key, or a combination thereof. The slider mechanism thus presents another security level to overcome if the lock is to be bypassed.

So-called tryout keys have been known for at least seventy-five years by locksmiths and were first developed to open motor vehicle locks by exploiting vertical tolerances between the depth increments used in a wafer lock. Basically, the tryout key is bitted at each wafer position to a depth that is halfway between two adjacent depth increments for that position, which is within the manufacturing tolerance of each of those depth increments, so that bitting the key to the halfway increment will work if either of the adjacent bit increments is correct for that position of the keyway. A total of 64 keys, for example, could open 4096 different General Motors sidebar locks in the United States in the 1960s. This comprised every possible combination of a six wafer lock with four depth increments for each wafer. Tryout keys allowed locksmiths to carry relatively few keys to open all cars.

The manipulation of individual tumblers within a high security lock, such as the Medeco lock described above, is extremely difficult using any form of conventional pick. The lock employs security pins, paracentric keyways, and a sidebar as a secondary locking system. Newer lock designs add another layer of security by blocking the action of the sidebar unless a slider is moved to the correct position by the key, making picking of the lock by conventional means even more difficult.

The primary deterrent to picking these high security locks is the aforementioned need to rotate each bottom pin to one of three precise angles. Each lock or group of locks will have a unique sidebar code, which is the composite group of angled cuts for each pin.

Additionally, some high security locks such as the Medeco locks employ secondary channels or false gates on each pin to provide a false indication as to when the pins are in the correct rotational position to permit the sidebar fence to properly engage the pins. For an even higher level of security, the Medeco locks may employ a special bottom pin in one or more positions along the keyway that has a vertical sidebar channel that is precisely the dimension of the leg of the protruding fence. This pin, identified as an ARX by Medeco, renders all forms of manipulation almost impossible. In order to successfully bypass the security features of a high security lock, such as the Medeco Biaxial lock, two things must simultaneously occur: the bottom pins must be raised to the shear line and the pins must be properly rotated to allow the sidebar to retract. In some of the newer lock, a slider must also be positioned to allow the proper interaction of the slider fence with the gates in the pins.

Even if the precise sidebar code is known for the target lock it is virtually impossible to utilize that information during picking because of the difficulty in rotating each pin to the correct position. Picking difficulty is compounded by the use of at least two security pins which provide a false indication when they are at the shear line. The false vertical channels on each bottom pin also add to the difficulty. Finally, the blocking action of the sidebar can prevent the setting of pins at the shear line, thus effectively preventing the lock from being feel-picked.

In these respects, the lock pin rotational position setting key and method of use of the key according to the present disclosure substantially departs from the conventional concepts and designs of the prior art locking picking tools and techniques, and in so doing provides devices and methods primarily developed for the purpose of compromising high security locks.

SUMMARY

In view of the foregoing limitations and disadvantages in the known types of devices for and methods of compromising locks, the present disclosure describes a new lock pin rotational position setting key and method of use which may be utilized for compromising high security locks that include multiple security features.

In one aspect, the present disclosure relates to a pin setting key for setting rotational orientations of pins located in a plug of a lock. The plug defines a keyway and a plurality of bores positioned along and extending from the keyway, and the lock includes a bottom pin positioned in each of the bores and being slidable and rotatable with respect to the bore. Each of the bottom pins has a contact surface permitting the bottom pin to be rotated in the bore by contact with a bitting surface. The pin setting key may comprise a bow portion and a blade portion for inserting into a keyway, with the blade portion having a longitudinal axis and a bow end and a tip end. The blade portion has a plurality of bitting positions located between the bow end and the tip end, and at least one of the bitting positions corresponds to one of the bores of the plug such that insertion of the blade portion into the keyway aligns the bitting position with one of the bores. The blade portion is bitted at each bitting position, with each bitting position including a pair of bitting surfaces. Each bitting surface is configured to rotate one of the bottom pins when the contact surface of the pin contacts the bitting surface. Each bitting surface of the pair of bitting surfaces may be offset from a central location of the respective bitting position. Each bitting surface has an axis, and the axis of each bitting surface extends generally transverse to the longitudinal axis of the blade.

In another aspect, the present disclosure relates to a method of picking a lock which includes providing a pin setting key configured to set the rotational orientation of each of the pins of the lock. The method further includes setting the rotational orientation of the pins of the lock by inserting the pin setting key into the keyway of the lock to cause rotation of the pins as the pins seat against bitting surfaces of the blade, and applying rotational torque to the plug of the lock to cause legs of a sidebar of the lock to engage a gate on each pin. If the setting of the pins by the pin setting key allows the sidebar to move, then the setting key is withdrawn while maintaining torque on the plug to hold the rotational orientation of the pins set by the setting key as the key is withdrawn so that the legs of the sidebar resist rotation of the pins from the rotational orientation. The method also includes releasing torque from the plug of the lock after the pin setting key have been withdrawn, inserting a tension wrench into the keyway and reapplying torque to the plug to move the legs of the sidebar into engagement with the gates in the pins, and manipulating the position of the pins in bores of the plug of the lock with a pick the align the junctures of the pins at the shear line.

In still another aspect, the present disclosure relates to a method of bumping a lock that includes providing a pin setting key for setting the rotational orientation of each of the pins of the lock and removing a portion of a shoulder of the key adjacent to a blade portion of the key to permit the blade to move in the keyway in a manner such that each of the bitting positions on the blade portion are capable of moving past the pins of the lock corresponding to the respective bitting positions. The method further comprises setting the rotational orientation of the pins of the lock by inserting the pin setting key into the keyway of the lock to cause rotation of the pins as the pins seat against the bitting surfaces of the blade, and applying rotational torque to the plug of the lock to cause legs of a sidebar of the lock to engage a gate on each pin. If the setting of the pins by the setting key allows the sidebar to move, the rotational torque is maintained on the plug by the key while the bitted positions of the pin setting key in the keyway engage a corresponding pin. The method includes applying an impulsive force to the key to move the blade of the key further into the keyway such that the pins are moved rapidly upwardly in the bore of the plug.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components or to the particulars of the steps set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
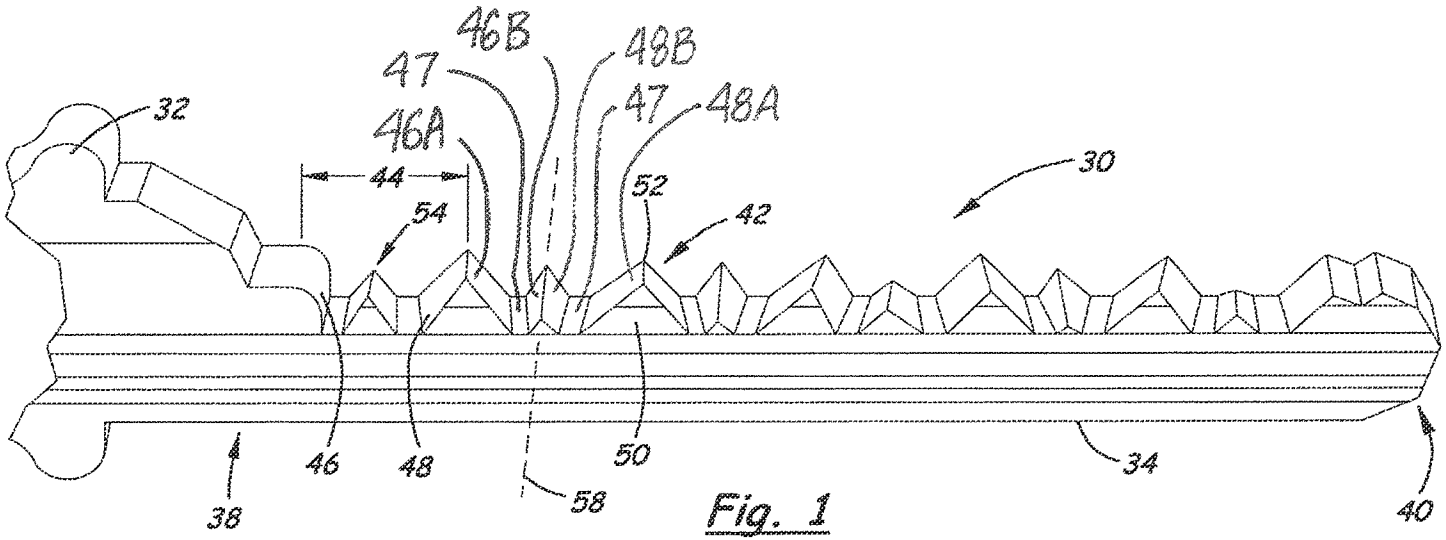
FIG. 1 is a schematic perspective view of the blade portion of the new lock pin rotational position setting key according to the present disclosure.

With reference now to the drawings, and in particular to FIGS. 1 through 9 thereof, a new lock pin rotational position setting key and method of use embodying the principles and concepts of the disclosed subject matter will be described.

In general, the pin setting key 30 of the present invention takes advantage of a number of characteristics of known high security locks to compromise the security of the locks so that the locks may be picked or bumped. In some embodiments, the splitting of tolerances utilized in the high security locks is utilized so that more pin rotational positions may be addressed with fewer combinations of bitting surface orientations. In some implementations, the use of the pin setting keys relies upon the interaction between the legs of the sidebar and the gates in the pins to allow the lock to be both picked and bumped. As will be described in greater detail below, the pin setting keys of the disclosure "set" the rotational position of each bottom pin so that the lock can be bumped or picked through further action, and do not open the lock in the normal manner with a key that replicates the correct bitting.

The pin setting keys of the disclosure may be configured to take advantage of limitations that lock manufacturers have placed upon the number of combinations of pin rotational positions that may be utilized in some types of high security locks.

In greater detail, one aspect of the disclosure relates to a pin setting key 30 for use on a lock 10, and various embodiments of the key 30 are highly suitable for use on a pin tumbler type of lock, although the key may find application with other types of locks, and thus is not limited in usefulness to the pin tumbler type of lock 10. The key 30 is useful for setting the rotational orientations of one or more pins 12 of the lock 10. The pins 12 may comprise the bottom pins of a lock that are each located in a bore 14 in the plug 16 of a lock 10. The plug 16 may be positioned in a shell, which may have corresponding bores that may be selectively aligned with the bores in the plug. A top pin 18 may abut against the bottom pin 12 of each of the respective bores 14. The plug 16 may define a keyway 20, and a plurality of the bores 14 may be positioned along the extent of the keyway, and the bores may extend from the keyway. The bottom pin 12 positioned in each of the bores 14 may be slidable with respect to the bore in order to move the top pin 18 when the bottom pin is moved by contact with the blade of the key or other device. The bottom pin 12 may also be rotatable with respect to the respective bore 14. Each of the bottom pins 12 may have a contoured contact surface 22 that permits the bottom pin to be rotated in the bore 14 by a generally complementarily-shaped bitting surface, such as will be described in the context of the key 30.

The pin setting key 30 may include a bow portion 32 and a blade portion 34 for inserting into the keyway 20. The blade portion 34 may have a longitudinal axis 36 extending from a bow end 38 of the blade portion to a tip end 40 of the blade portion.

The blade portion 34 has an upper edge 42 that may be contoured. The blade portion may have a plurality of bitting positions 44 that are located between the bow 38 and tip 40 ends. Each of the bitting positions 44 may correspond to one of the bores 14 of the plug 16 such that insertion of the blade portion 34 into the keyway 20 aligns the bitting position with a respective one of the bores. The blade portion 34 may be bitted or cut at each of the bitting positions 44. In the most preferred embodiments, the blade portion is bitted to the lowest permitted bitting depth for the blade portion at each of the bitting positions 44. The lowest bitting depth may correspond to the deepest or furthest depth that is employed or permitted for the type of lock for which the key is being made. For example, in the case of the Medeco type locks, this may be a 6 or 6.5 depth.

Figure 3:
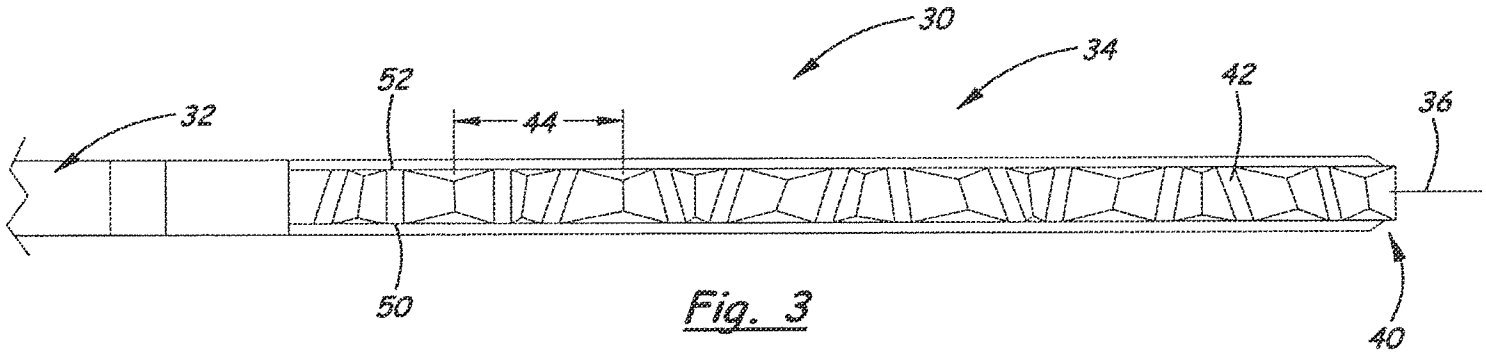
FIG. 3 is a schematic edge view of the pin rotational position setting key of FIG. 1.
Figure 2:
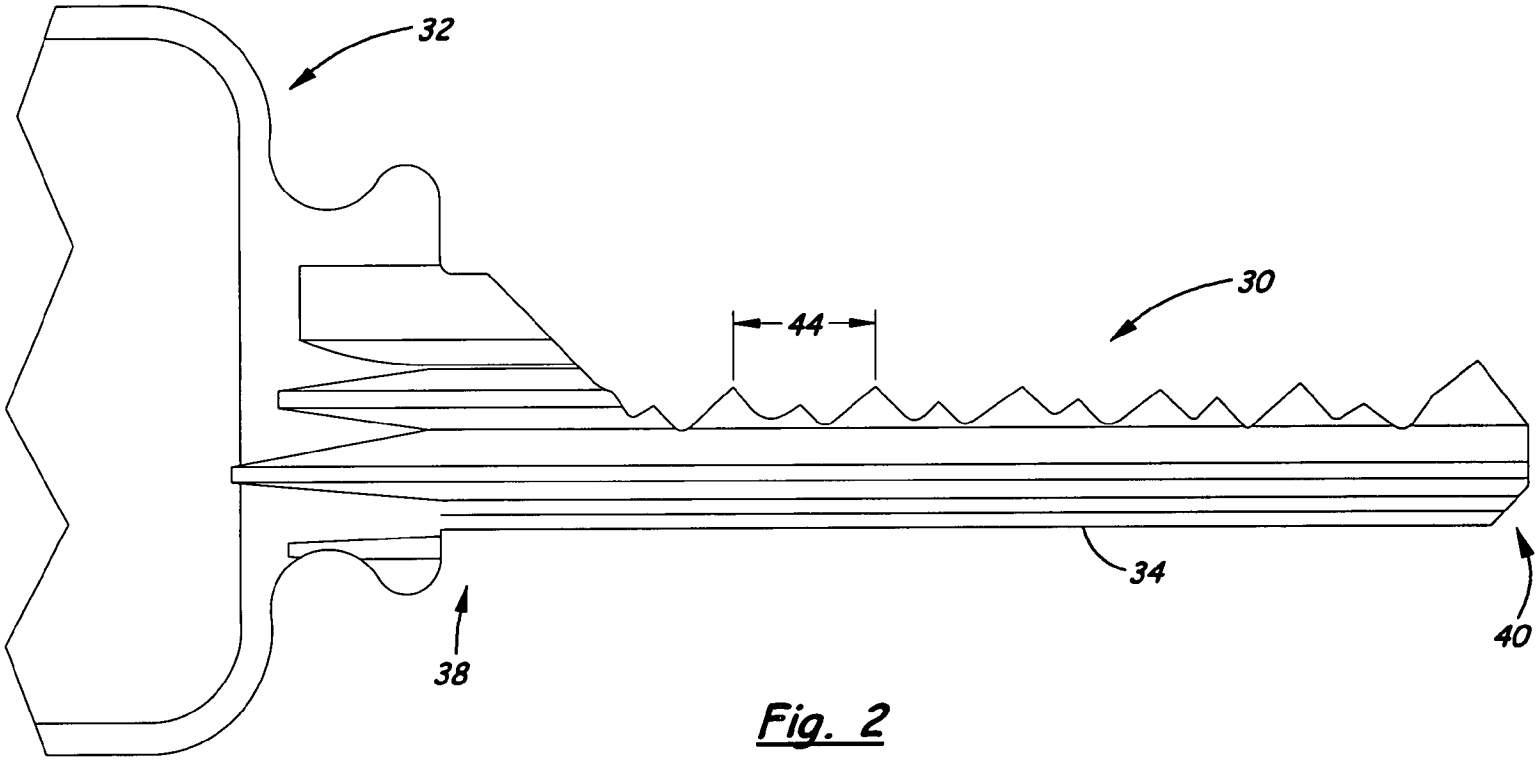
FIG. 2 is a schematic side view of the pin rotational position setting key of FIG. 1.
Figure 4:
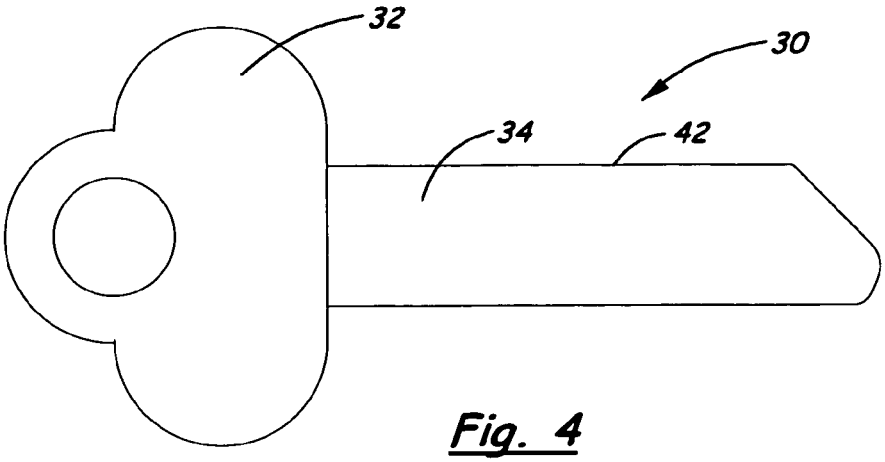
FIG. 4 is a schematic side view of a blank pin rotational position setting key, according to an illustrative embodiment.
Figure 5:
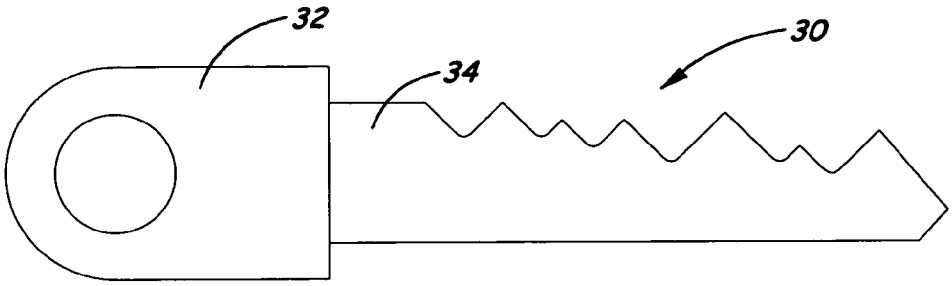
FIG. 5 is a schematic side view of a pin rotational position setting key, according to an illustrative embodiment that is bitted for a specific lock.
Figure 6:
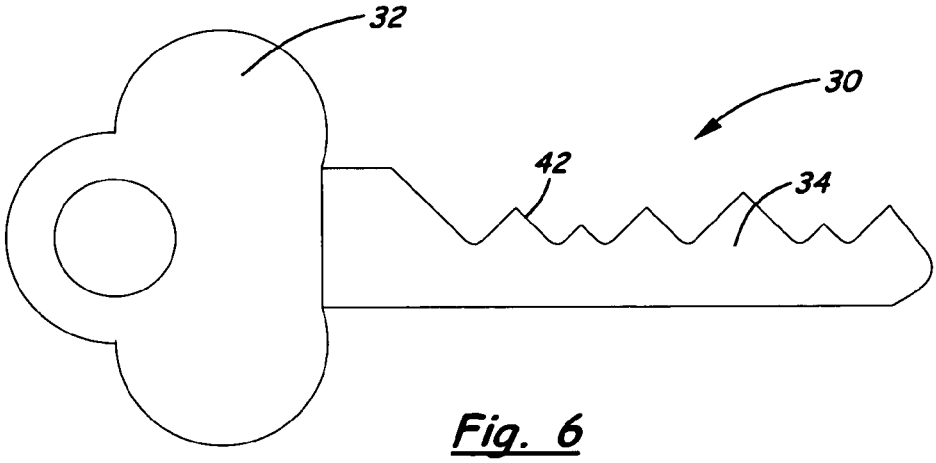
FIG. 6 is a schematic side view of a pin rotational position setting key, according to an illustrative embodiment.
Figure 7:
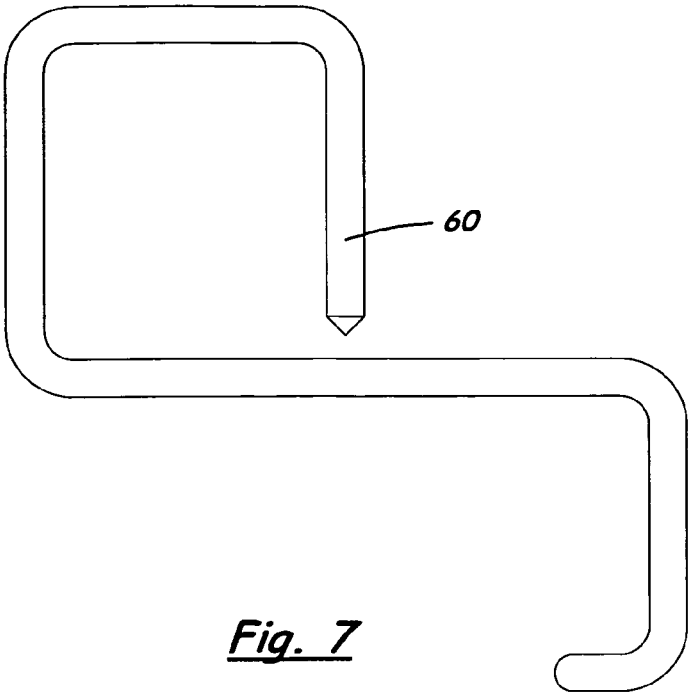
FIG. 7 is a schematic side view of a slider engagement member, according to an illustrative embodiment.
Figure 9:
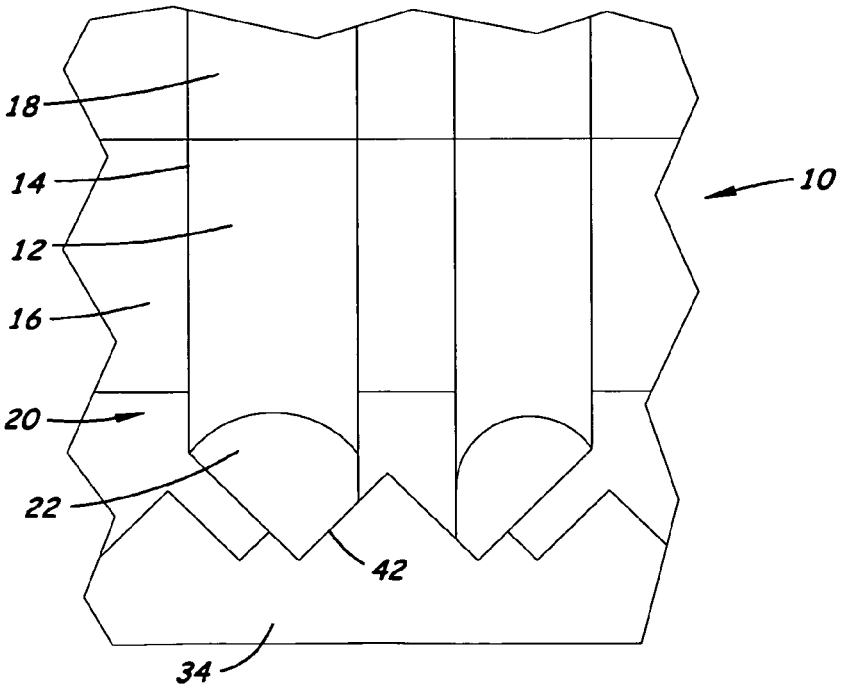
FIG. 9 is a schematic partial side view of a key inserted in the plug of a lock showing the interaction between the contact surfaces of the bottom pins and the bitted surfaces of the key.
Figure 8:
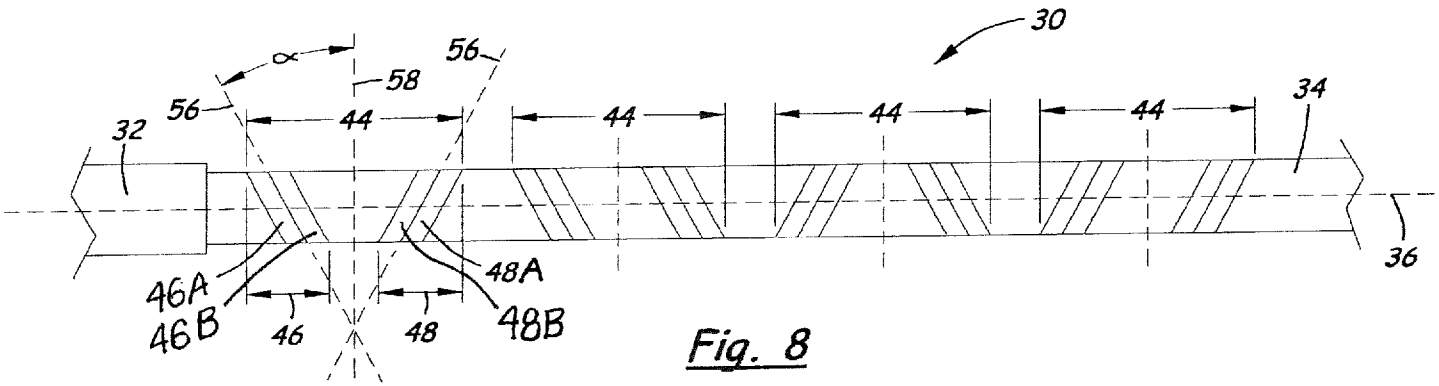
FIG. 8 is a schematic edge view of the pin rotational position setting key of FIG. 1 showing the bitting positions.

In one significant aspect of the pin setting key 30, each bitting position 44 may include a pair of bitting surfaces 46, 48. At least one of the bitting surfaces, and in various embodiments both of the bitting surface 46, 48, may be configured to contact the contoured contact surface 22 of the bottom pin and cause rotation of the corresponding bottom pin 12 when the contact surface 22 of the pin contacts one of the bitting surfaces 46, 48. Each of the bitting surfaces 46, 48 may form or define at least a portion of a groove cut into the upper edge 42 of the blade portion. In some embodiments, the groove is substantially V-shaped and extends from one side face 50 of the blade portion to the other side face 52 of the blade portion. The groove of each bitting surface may be formed by a major bitting surface portion and a minor bitting surface portion. For example, as shown in FIGS. 1 through 3 and 8, the bitting surface 46 of the bitting position 44 may include a major bitting surface portion 46A and a minor bitting surface portion 46B, and similarly the bitting surface 48 may include a major bitting surface portion 48A and a minor bitting surface portion 48B. Generally, the major bitting surface portion and the minor bitting surface portion of each bitting surface converge toward each other, and are oriented at a similar angle with respect to the longitudinal axis of the blade portion. Optionally, as shown in FIGS. 1 and 3, the groove may include a bottom surface 47 or root that is positioned between the major bitting surface portion 46A and the minor bitting surface portion 46B of the bitting surface 46, such that the bitting surface may have a generally truncated V-shaped configuration.

In various embodiments of the key 30, each of the bitting surface 46, 48 of the pair of bitting surfaces is offset from a central location of the respective bitting position 44. In some embodiments, one of the bitting surfaces 46 of the pair of bitting surfaces of the bitting position is offset from a central location 54 toward the bow end 38 of the blade portion and one of the bitting surfaces 48 of the pair of bitting surfaces for a bitting position is offset from the central location 54 toward the tip end 40 of the blade portion.

Each bitting surface 46, 48 may have an axis 56, and the axis may extend generally transverse to the longitudinal axis 36 of the blade portion. The axis 56 of each bitting surface 46, 48 may not be oriented perpendicular with respect to the longitudinal axis 36. The axis 56 may be oriented such that the axis is rotated from a central axis 58 for the bitting position 44 that extends substantially perpendicular to the longitudinal axis 36 of the blade portion. The axis 56 of the bitting surface 46 may be rotated with respect to the central axis 58 in a clockwise direction or a counterclockwise direction.

The axis 56 may be rotated with respect to the central axis 58 by a predetermined angle $\alpha$. The predetermined angle $\alpha$ is greater than zero degrees, and may be less than approximately 90 degrees. The predetermined angle $\alpha$ may be less than approximately 30 degrees, and may be less than approximately 20 degrees. In a highly preferred embodiment, the predetermined angle $\alpha$ is approximately 10 degrees, so that the axis 56 of each bitting surface is rotated either approximately 10 degrees clockwise or 10 degrees counter-clockwise with respect to the central axis 58. These two bitting position orientations take advantage of typical tolerances or variations of approximately 10 degrees (plus or minus) that is permitted between the rotational positions of many of the aforementioned high security locks. These high security locks typically utilize three pin rotational positions that are separated by approximately 20 degrees, with one pin rotational position being substantially parallel to the central axis 58, and the other two rotational positions are rotated approximately 20 degrees clockwise and 20 degrees counterclockwise from the central axis. Utilizing the tolerances typically permitted, the three bit rotational positions may be addressed using two bitting surface orientations at 10 degrees clockwise and 10 degrees counterclockwise, so that each of the bitting surface orientations is able to rotate the pin to a position that works for two of the pin rotational positions. Due to the ability of the bitting surface orientations to address more than one pin rotational orientation, it is not required to have a key that is bitted with precisely the same bitting surface orientation.

The particular combination of orientations of the bitting surfaces 46, 48 for each bitting position may be any combination. It will be recognized that being able to utilize two bitting surface orientations for three pin rotational positions reduces the number of combinations required to address all of the possible combinations of pin rotation positions that are needed to address all of those combinations. The use of two bitting surfaces at each bitting position (even though only one bitting surface will actually be engaged by the contact surface of each pin) essentially removes the need to determine at which offset the contact surface of the pin is located, as both offset locations are able to be engaged without such knowledge.

It can be appreciated from the foregoing that these features significantly reduce the number of pin setting keys having different combinations of rotational positions and offset positions that are needed to address the number of possible combinations of these factors in locks. An analysis of the codes utilized by a high security lock manufacturer revealed that the manufacturer reserved a number of distinct sidebar codes for use only on non-master-keyed cylinders which may be utilized, for example, on perimeter entry points in protected facilities. The discovery that the number of pin rotational positions has been limited by the manufacturer to a smaller subset of all possible combinations for these types of locks thereby reduces the number of combinations of bitting surface orientations that need to be included in the setting keys of the disclosure in order to compromise those locks. In other words, due to these limitations placed on the number of codes used for these lock applications, the number of combinations of pin rotational positions that need to be embodied in the pin setting keys may be greatly reduced.

For example, it is believed that one manufacturer has reserved approximately 729 sidebar codes for non-master keyed cylinders, and this limitation allows four of the pin setting keys with different combinations of bitting positions to actuate the sidebar in all such locks. A matrix of angles for the different code selling keys may be defined by the sidebar codes that have been selected by the manufacturer for these non-master keyed systems. The user of the pin setting keys does not need to know the combination of pin rotation angles for freeing the sidebar of the target cylinder to be successful in opening it.

It will be appreciated that the use of proprietary keyways can make the generation of suitable pin setting keys more difficult. The present disclosure describes a simple method to generate a blank key that can be bitted for the proper depth and rotation to allow for the duplication of restricted keyways as well as the preparation of a pin setting key for bumping and picking utilizing the procedures set forth in this application.

For example, locks utilizing a slider (such as the so-called M3 model from Medeco) may have an extra wide keyway to accommodate the slider. The wide keyway design allows the paracentric characteristics of the keyway to be bypassed by the introduction of a relatively thin (such as, for example, approximately 0.035" thick) flat blank into the keyway without needing to form grooves in the blank to fit the wards in the keyway.

In some implementations, a first key portion is formed by reducing the thickness of a flat brass or steel key (such as the type utilized for many popular safe deposit lever locks) by milling the key to a thickness suitable for entering the keyway of the plug without engaging the wards of the keyway and thereby bypassing the wards. A second key portion may be provided with substantially the same horizontal and vertical dimensions as the first key portion. The two key portions (one relatively thicker, the other relatively thinner) may be utilized for the cutting of the first key portion as the first key portion alone may be too thin when an angled cutting wheel is applied to remove material. The first and second key portions provide sufficient thickness for insertion into a key cutting machine in order to form the bitting surfaces on the first key portion. The proper angles of rotation and depth for each bitting surface are cut on the first key portion supported by the second key portion.

There should be sufficient material on the thinner first key portion to properly interact with the chisel points of each bottom pin of the pin tumbler within the plug. The resulting first key portion can be utilized to open the lock. In some cases, the slider engagement member should be set into place in the keyway in order to move the slider to the correct position prior to rotation of the plug with a key.

In another aspect of the disclosure, a method of picking a lock may be practiced using one or more pin setting keys 30 for setting the rotational position of each of the pins of the lock to pick the lock. Initially, if the lock includes a slider in the keyway (such as is described in U.S. Pat. No. 6,945,082), the slider is depressed in the keyway using a tool such as, for example, a pick. Then, the rotational position of the pins 12 of the lock may be set using the pin setting key 30 This may be accomplished by inserting the pin setting key 30 into the keyway of the lock to cause rotation of the pins as the pins seat or press against one of bitting surfaces 46, 48 in the blade portion 34, and applying rotational torque to the plug 16 of the lock to cause legs of the sidebar of the lock to engage a gate on each pin. If the rotational setting of the pins by the setting key provides the proper positioning of the gates formed in each of the pins, the sidebar is allowed to move, and then the user knows that the key 30 includes a suitable combination of orientations. If the sidebar does not move when rotational torque is applied, then another setting key 30 with a different combination of bitting surface orientations may be tried, and this may continue until the key with a combination that is suitable for the particular pins of the particular lock is found.

When the pin rotations are suitably set to permit sidebar movement, then the setting key 30 may be withdrawn from the keyway 20 while maintaining torque on the plug 16 to hold or maintain the rotational orientation of the pins set by the setting key as the key is withdrawn from the key and the pins would otherwise be likely to move into other rotations as the pins contacted other bitting surfaces of the key. The legs of the sidebar engage the gates in the pins when the sidebar is moved inwardly, and this movement and engagement can serve to resist further rotation by contact between the contact surfaces 22 of the pins and the bitting surfaces, and thereby hold the rotational positions of the pins, while the key 30 is moved out of the keyway 20.

Once the key 30 is withdrawn, then the torque applied to the plug 16 may be released or otherwise terminated, and the pins should maintain their respective rotational positions even though the legs of the sidebar are likely to move out of the gates of the respective pins. A tension wrench or other tool suitable for applying torque to the plug may be inserted in the keyway. Torque may be applied to the plug 16 to move the legs of the sidebar into engagement with the gates in the pins. The position of the pins 12, 18 in the bores 14 of the lock may be manipulated with a tool such as a pick that is suitable for contacting the contact surfaces 22 of the pins in order to move the pins upwardly in the bores. The engagement of the legs of the sidebar with the gates in the pins should resist rotation of the pins as the pins are being manipulated using the tool. The manipulation of the positions of the pins in the bores may proceed in a known manner until the junctures between the top and bottom pins aligns with the shear line of the lock.

In yet another aspect of the disclosure, a method of bumping a lock may be practiced using one or more pin setting keys 30 for setting the rotational position of each of the pins of the lock to bump the lock. Initially, the key is formed in a manner that permits the blade portion to move in the keyway so that each of the bitting positions on the blade portion is capable of moving past the pins of the lock corresponding to the respective bitting positions. This functionality may be accomplished by removing a portion of the shoulder of the key that is located adjacent to the blade portion, which permits a larger section of the key to move into the keyway. In greater detail, a slight amount of material may be removed from the shoulder to allow forward movement of the key in the keyway during the application of impulse energy to the key. If the lock includes a slider located in the keyway, the slider is depressed using a tool such as a pick.

The rotational orientation of the pins of the lock may be set by inserting the setting key into the keyway of the lock to cause rotation of the pins as the pins seat against the bitting surface in the blade portion. Rotational torque may be applied to the plug of the lock to cause legs of a sidebar of the lock to engage a gate on each pin. If the setting of the pins by the setting key allows the sidebar to move in the plug, that movement generally indicates that the pins are set in the proper rotational position. The blade portion of the pin setting key 30 is positioned in the keyway 20 so that each of the bitting positions 44 engages a corresponding pin. If the lock 10 includes a slider located in the keyway, a slider engagement member may be inserted into the keyway to engage and move the slider. The slider engagement member 60 may be wedged between the slider of the lock and the plug of the lock, which causes the slider to be moved forward. Although there may be many slider steps available, the fence position of the slider may be constant with respect to the sidebar gate, so that the step location of the slider is irrelevant to the bypass of the slider feature if the entire slider assembly is moved to the correct position.

Illustratively, the slider engagement member 60 may comprise a specially formed wire that may be approximately 0.040" in diameter.

An impulsive force or quick blow may be applied to the key to move the blade of the key further into the keyway such that the pins are moved rapidly upwardly in the bore of the plug. Rotational torque may be applied (or may be maintained) to the plug of the lock while the impulsive force is applied to the key, and the lock may be opened if the bottom and top pins are separated and the separation is aligned with the shear line when the rotational torque is applied.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lock pin setting system for setting rotational orientations of pins of a lock, the system comprising:

a lock utilizing pin sliding and pin rotation by a key that is correctly bitted to correctly operate the lock, the lock having a plug defining a keyway and a plurality of bores positioned along and extending from the keyway, the lock including a bottom pin positioned in each of the bores and being slidable and rotatable with respect to the bore, each of the bottom pins having a contact surface permitting the bottom pin to be rotated in the bore by contact with a bitting surface of the correctly-bitted key, each pin being configured to be aligned with a shear line of the plug when contacting one of the bitting surfaces located at a plurality of bitting depths, the plurality of bitting depths for the correctly-bitted key being predefined so the key is able to correctly operate the lock by moving the bottom pins to alignment with the shear line, the plurality of predefined bitting depths capable of moving the bottom pins to the shear line ranging from a predefined highest bitting depth of 1 to a predefined lowest bitting depth of 6 with multiple bitting depths between 1 and 6, each of the predefined bitting depths being separated by a uniform depth increment;

a lock pin setting tool comprising:

a bow portion and a blade portion for inserting into the keyway of the lock, the blade portion having a longitudinal axis and a bow end and a tip end;

the blade portion having a plurality of bitting positions located between the bow end and the tip end, each of the bitting positions corresponding to one of the bores of the plug of the lock such that insertion of the blade portion into the keyway aligns the bitting position with one of the bores, the blade portion being bitted at each bitting position;

each bitting position including a pair of bitting surfaces, each bitting surface of the pair of bitting surfaces being configured to rotate one of the bottom pins when the contact surface of the pin contacts the bitting surface;

each bitting surface of the pair of bitting surfaces of each bitting position being offset from a central location of the respective bitting position; and each bitting surface having an axis extending generally transverse to the longitudinal axis of the blade portion; and wherein one or both of the bitting surfaces of each of the bitting positions is bitted to a bitting depth selected from the group of bitting depths comprised of 6 and 6.5 for the blade portion;

wherein the bitting depth of 6.5 is lower than the predefined lowest bitting depth of 6 for the lock by half of one of the predefined depth increments; and wherein the bitting surfaces of the bitting positions along the blade portion alternate between a relatively lower bitting depth and a relatively higher bitting depth.

* * * * *